United States Patent [19]

Grange et al.

[11] 4,352,571

[45] Oct. 5, 1982

[54] APPARATUS FOR HOMOGENIZING LIQUIDS

[75] Inventors: Arthur Grange; Jack Hollings, both of West Yorkshire, England

[73] Assignee: Lucas Industries Limited, Birmingham, England

[21] Appl. No.: 242,556

[22] Filed: Mar. 11, 1981

[30] Foreign Application Priority Data

Mar. 20, 1980 [GB] United Kingdom ..... 8009360

[51] Int. Cl.[3] ..... B01F 11/02

[52] U.S. Cl. ..... 366/127; 366/119

[58] Field of Search ..... 366/127, 119, 174, 600; 74/86

[56] References Cited

U.S. PATENT DOCUMENTS

| | | | |
|---|---|---|---|
| 2,498,737 | 2/1950 | Holder | 366/127 X |
| 3,278,165 | 10/1966 | Gaffney | 366/119 |
| 3,926,413 | 12/1975 | D'Upo | 366/174 |
| 4,129,387 | 12/1978 | Grange | 366/119 |

*Primary Examiner*—Edward J. McCarthy

*Attorney, Agent, or Firm*—Holman & Stern

[57] ABSTRACT

Apparatus for homogenizing a liquid, the body of the apparatus having therein an homogenization chamber within which is located a blade caused to vibrate by a jet of liquid to be homogenized impinging thereon. Magnetostrictive or piezoelectric devices are utilized to impart vibrational energy to the liquid in the chamber additional to that imparted thereto by the blade.

6 Claims, 2 Drawing Figures

APPARATUS FOR HOMOGENIZING LIQUIDS

This invention relates to apparatus for homogenizing a liquid, such as an emulsion, dispersion or suspension.

It is known from, for example British Pat. No. 1,453,864 and U.S. Pat. No. 4,129,387 to homogenize a liquid by directing a jet of the liquid onto a vibratory blade so that the turbulent flow of liquid over the blade causes the blade to vibrate. Vibration of the blade results in cavitation and sheer in the liquid which is effective in homogenizing a large number of liquids. There is, however, a demand for apparatus which will homogenize a wider variety of liquids and an object of the present invention is to provide such apparatus in a simple and convenient form.

Accordingly, the invention resides in apparatus for homogenizing a liquid, including a hollow body defining a homogenization chamber, a vibratory blade located in the chamber, means for directing a jet of the liquid onto the blade so as to cause the blade to vibrate, and further means for imparting vibrational energy to the liquid in the chamber additional to the vibrational energy imparted thereto by the action of the liquid jet on the blade.

Desirably said further means includes at least one electromechanical transducer mounted in spaced relationship with one of the blade surfaces which converge to define the blade edge.

Conveniently a respective electromechanical transducer is mounted in spaced relationship with each of said blade surfaces.

Preferably means is provided for adjusting the spacing between the or each transducer and its associated blade surface.

Conveniently said further means includes a device coupled to the blade to impart said additional vibrational energy by way of the blade.

Figure 1:
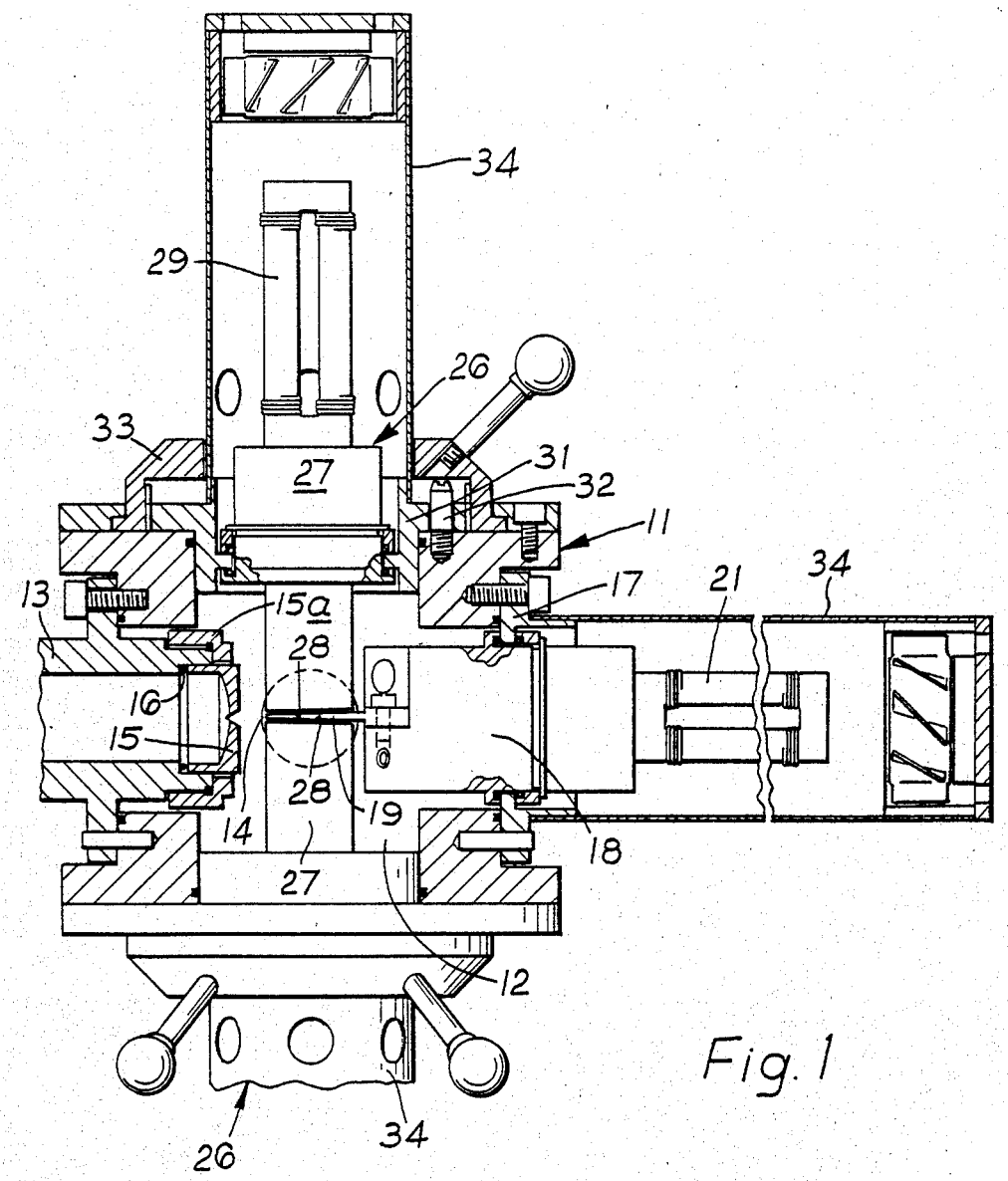
Figure 2:
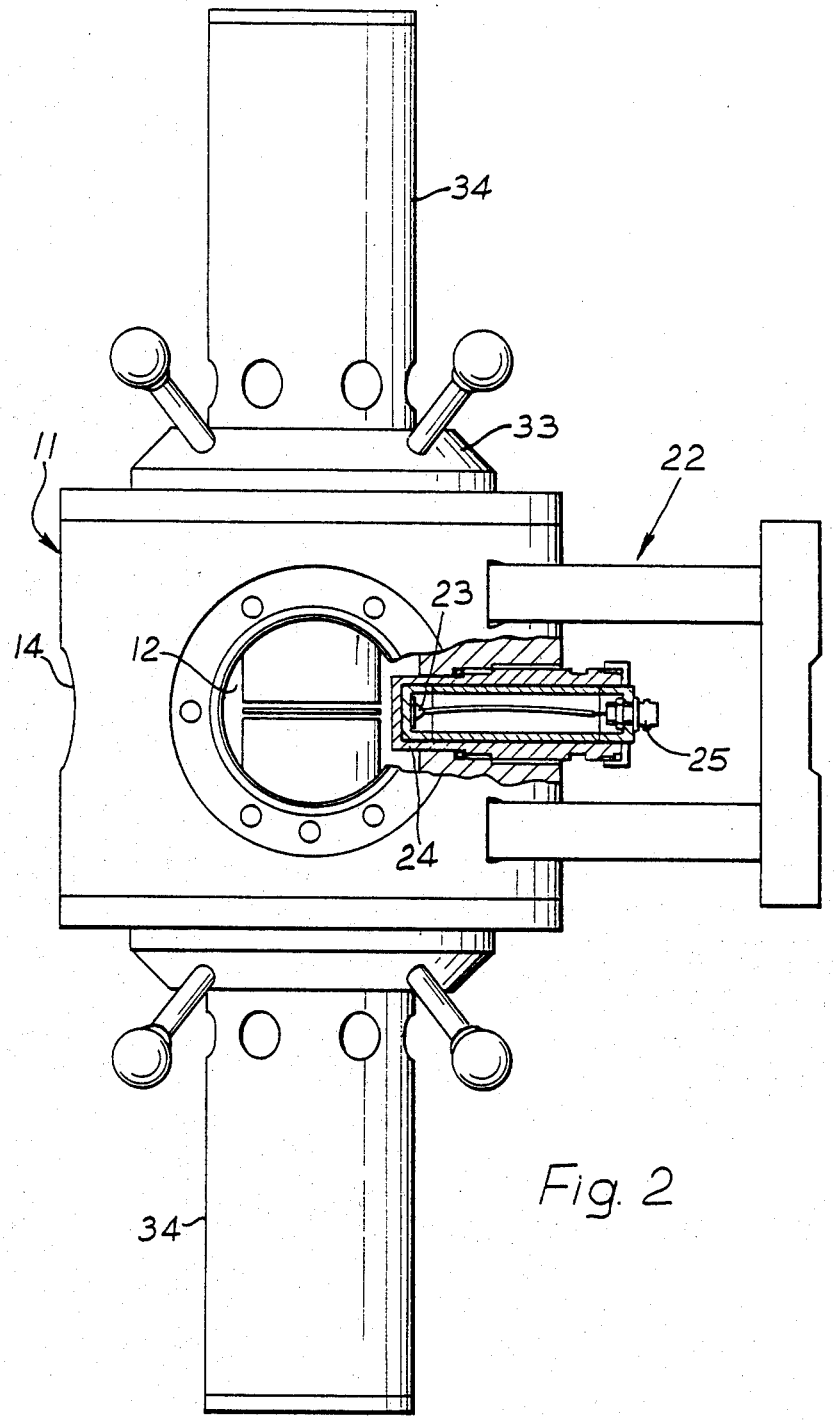

One example of the invention is illustrated in the accompanying drawings wherein:

FIG. 1 is a side elevational view partly in section of an apparatus for homogenizing a liquid; and FIG. 2 is a front elevational view of the apparatus shown in FIG. 1, partly in section, and with the inlet nozzle of the apparatus omitted.

Referring to the drawings, the apparatus includes a hollow, generally cylindrical body 11 defining an homogenization chamber 12. Extending radially of the body 11 into the chamber 12 is an inlet conduit 13 for liquid to be homogenized. Spaced by 90° around the body 11 from the inlet conduit 13 is an outlet conduit 14 through which homogenized liquid leaves the apparatus. At its radially innermost end the inlet conduit 13 supports a nozzle 15 formed with a narrow, transversely exending slit through which, in use, a jet of the liquid to be homogenized is directed into the homogenization chamber 11. A cap 15*a* serves to secure the nozzle 15 to the conduit 13, with an O-ring seal 16 being trapped between the nozzle and the conduit.

Diametrically opposite the inlet conduit 13 the body 11 is formed with an aperture around which is secured a mounting ring 17. The mounting ring 17 supports an elongate resonant mount 18, the mount 18 supporting, at its end projecting into the chamber 12, a blade 19 arranged with the sharp edge of the blade extending parallel with and spaced from the slit in the nozzle 15. The mounting ring 17 is engaged with the resonant mount 18 at a nodal position along the length of the mount 18 and the mount 18 is conveniently arranged to have a length equal to an odd number of half wavelengths of its natural resonant frequency.

In use a jet of liquid issuing from the nozzle 15 impinges directly on the sharp edge of the blade 19 thereby causing the blade 19 to vibrate and the mount 18 to resonate. Secured to the outermost end of the mount 18 is a magnetostrictive device 21 which, when appropriately electrically energised, generates vibration of the blade 19, resulting in cavitation in the liquid.

Diammetrically opposite the outlet conduit 14 the body 11 supports a radially extending sensor 22. The sensor 22 includes a piezoelectric crystal cartridge 24 containing a piezoelectric crystal 23. The cartridge 24 projects into the chamber 12 and the crystal 23, in use, provides an electrical output dependent upon the vibrational accoustic energy in the homogenization chamber 12. The output from the crystal 23 is transmitted to an external measuring device (not shown) by way of an electrical connector socket 25 forming part of the cartridge 24. The cartridge 24 is replaceable, and is received as a screw fit in a mounting plate secured to the body 11. An O-ring seal is trapped between mutually presented shoulders on the cartridge 24 and the mounting plate to seal the chamber 12 against loss of liquid between the mounting plate and the cartridge.

The two opposite axial ends of the body 11 are open and receive electromechanical transducer assemblies 26. The two transducer assemblies 26 are identical and each comprises a transducer 27 having a working surface 28 presented to a respective surface of the blade 19 and a magnetostrictive device 29 substantially identical to the device 21. Encircling each transducer 27 intermediate its ends is a support collar 31 each support collar 31 being slidably received in the body 11 for movement relative to the body 11 in the direction of the longitudinal axis of the body 11. An O-ring seal encircles each collar 31 sealing the sliding interface between the collar and the body. Respective dowels 32 secured to the body 11 extend through respective apertures of the collars 31 and prevent rotational movement of the collars 31 relative to the body 11 while permitting the axial sliding movement mentioned above. The outer periphery of each of the collars 31 is formed with a screw thread which is in screw threaded engagement with a corresponding internal thread of a respective adjustment ring 33. The two adjustment rings 33 are retained on the body 11 by a mounting arrangement which permits rotation of each of the rings 33 relative to the body about the longitudinal axis of the body while at the same time preventing axial movement of the rings 33 relative to the body. Each of the rings is provided with one or more handles to facilitate manual movement of the rings relative to the body. It will be recognised that when a ring 33 is rotated about the axis of the body then by virtue of the screw thread connection between that ring 33 and its respective collar 31 the collar 31 will be caused to move axially, it being recalled that rotational movement of the collar 31 is prevented by the appropriate dowel 32. The direction of axial movement will of course depend upon the direction of rotation of the respective ring 33. Each transducer 27 is clamped to its respective collar 31 and so moves axially with its respective collar 31. Axial movement of a transducer 27 adjusts the positioning of its working face 28 in relation to the mutually presented face of the blade 19. Thus the gap between the working face 28 of the transducer and the corresponding face of the blade 19 can be adjusted by rotational of the respective adjustment ring 33.

The two opposite faces of the blade 19 are not parallel, and converge to define the sharp edge of the blade presented to the nozzle 15. In the example illustrated in the drawings the working faces 28 of the transducer 27 are inclined with respect to the axis of the body so as to lie parallel to the corresponding surfaces of the blade 19. However, it is to be understood that in some applications it may be preferable to arrange that the working surfaces 28 of the transducers 27 are parallel to one another, lying at right angles to the axis of the body. Alternatively, in other applications it may be preferred to contour the working faces 28 by providing them with, for example, a wave pattern.

During use of the apparatus the liquid to be homogenized is pumped through the inlet conduit 13 to the nozle 15 from which it issues as a high speed jet impinging upon the blade 19. The movement of the liquid over the blade 19 causes the blade to vibrate. The vibrational accoustic energy in the homogenization chamber 12 is transmitted by the cartridge 24 to the crystal 23 the electrical output signal of which is supplied to an external measuring device. It is known that the gap between the faces of the blade 19 and the corresponding working faces 28 of the transducers 27 has a controlling effect on the vibrational energy imparted to the liquid. Thus while observing the external measuring device the axial position of the two transducers 27 are adjusted using their respective adjustment rings 33 until the output signal of the crystal 23 is maximized. At this point the magnetostrictive device 21 is appropriately electrically energised to add further vibrational energy to the liquid in the homogenization chamber by way of the mount 18 and the blade 19. Similarly the magnetostrictive devices 29 of the transducers 27 are also appropriately electrically energised to further add to the vibrational energy within the chamber 12 by way of their working faces 28.

The additional energy adds to the cavitation produced in the liquid by the blade 19 alone and homogenised liquid issues from the chamber 12 by way of the outlet conduit 14.

Typically the energy used to pump the liquid to be homogenized to the apparatus is of the order of 2.1 K watts and the energy supplied to the transducers 27 and the transducer defined by the device 21, mount 18 and blade 19 is in total only 300 watts. However despite the relatively small amount of energy supplied to the apparatus by the transducers it is found that the use of the transducers significantly increases the effectiveness of the apparatus in homogenizing liquids.

As an alternative to the embodiment described above a powered mechanism could be provided for adjusting the axial positions of the transducers 27, and the axial positions could then be adjusted automatically in response to the output from the crystal 23. In such an arrangement as the optimum setting of the transducers 27 varies, as a result for example of varying viscosity of liquid, varying temperature etc. the actual position of the transducers 27 would be appropriately adjusted to maintain the output of the crystal 23 at a maximum.

As a further alternative where the apparatus intended to operate primarily on a predetermined known liquid it is possible that the need for adjustment of the transducers 27 could be dispensed with, the apparatus being assembled with the transducers 27 in a fixed position, that fixed position being predetermined in accordance with the properties of the liquid to be homogenized.

It will be recognised that for some applications the transducers 27 may be dispensed with entirely, the whole of the additional vibrational energy being supplied by way of the mount 18 and blade 19 from the device 21. In such an arrangement the working surfaces 28 would be provided on non-vibratory guides which may, if desired, be adjustable in position in a manner similar to that of the transducers 27. However, what is more likely is that in certain applications the device 21 may be dispensed with, the additional vibrational energy being supplied by way of one or both of the transducers 27. In such an arrangement it would be possible to support the cartridge 24 on the mount 18 to sense the vibrational accoustic energy in the chamber 12.

As is apparent in FIG. 1 each of the magnetostrictive devices 21 and 29 is received in a ventilated casing 34, the casings 34 being attached to the body 11 and containing respective electrically powered fans for forcing a flow of cooling air through the casings 34.

In each of the possible constructions described above the additional vibrational energy is generated by means of an appropriate electrically energised magnetostrictive device. It is to be understood however that such magnetostrictive devices can, if desired, be replaced by appropriate piezoelectric devices.

We claim:

1. Apparatus for homogenizing a liquid, including a hollow body defining a homogenization chamber, a vibratory blade located in the chamber, means for directing a jet of the liquid onto the blade so as to cause the blade to vibrate, and further means for imparting vibrational energy to the liquid in the chamber additional to the vibrational energy imparted thereto by the action of the liquid jet on the blade.

2. Apparatus as claimed in claim 1, wherein said further means includes at least one electromechanical transducer mounted in spaced relationship with one of the blade surfaces which converge to define the blade edge.

3. Apparatus as claimed in claim 2, wherein a respective electromechanical transducer is mounted in spaced relationship with each of said blade surfaces.

4. Apparatus as claimed in claim 2 or claim 3, wherein means is provided for adjusting the spacing between the or each transducer and its associated blade surface.

5. Apparatus as claimed in any one of the preceding claims 1 to 3, wherein said further means includes a device coupled to the blade to impart said additional vibrational energy by way of the blade.

6. Apparatus as claimed in claim 4, wherein said further means includes a device coupled to the blade to impart said additional vibrational energy by way of the blade.

* * * * *